US005257942A

United States Patent [19]

Taguchi

[11] Patent Number: 5,257,942

[45] Date of Patent: Nov. 2, 1993

[54] LEVER-OPERATED CONNECTOR ASSEMBLY

[75] Inventor: Naoto Taguchi, Shizuoka, Japan

[73] Assignee: Yazaki Corporation, Tokyo, Japan

[21] Appl. No.: 21,991

[22] Filed: Feb. 24, 1993

[30] Foreign Application Priority Data

Mar. 12, 1992 [JP] Japan ..... 4-053414

[51] Int. Cl.[5] ..... H01R 13/62

[52] U.S. Cl. ..... 439/157; 439/153

[58] Field of Search ..... 439/152-160, 439/372, 352, 353

[56] References Cited

U.S. PATENT DOCUMENTS

| | | | |
|---|---|---|---|
| 4,447,101 | 5/1984 | Gugliotti | 439/153 |
| 5,022,866 | 6/1991 | Harting et al. | 439/372 |
| 5,052,952 | 10/1991 | Lawson | 439/160 |
| 5,139,432 | 8/1992 | Sugiyama et al. | 439/372 |

FOREIGN PATENT DOCUMENTS 58-1178289 11/1983 Japan .

*Primary Examiner*—David L. Pirlot
*Attorney, Agent, or Firm*—Krass & Young

[57] ABSTRACT

A lever-operated connector assembly mainly used for connecting wire harness of an automobile, in which an operation lever is efficiently connected to pins projecting from a connector. The lever-operated connector assembly comprising: a connector; an operation lever to be rotatably connected to the connector; pins provided to the connector, the pins each having a pair of engagement flat portions which are substantially in parallel to each other, the engagement flat portions having opposing projections; engagement holes formed on the operation lever for engaging the pins; and guide notches being in communication with the engagement holes and opened at front portions of the operation lever, the guide notches each having a pair of opposing guide flat portions which are substantially in parallel to each other and are slidably contacted with the engagement flat portions, the guide notches having projections for preventing the connector and the operation lever from being disconnected from each other.

2 Claims, 5 Drawing Sheets

LEVER-OPERATED CONNECTOR ASSEMBLY

BACKGROUND OF THE INVENTION

1. Field of the Invention

This invention relates to a lever-operated connector assembly which is mainly used for connecting wire harness of an automobile.

2. Description of the Prior Art

A large force is required to connect male and female connectors to each other and to disconnect them from each other in a multi-pole connector. Therefore, in recent years, there has been used a connector assembly in which a lever is provided to the connector for connecting and disconnecting operations.

FIG. 5 shows an example of a female connector a of such connector as described above. The female connector a is provided with a pin b at both sides thereof and a guide channels c at a front portion thereof. Reference symbol d shows an operation lever which is integrally formed with synthetic resin material, in which three lever plates d1, d2, and d3 are connected to each other with an operating portion d4. Further, driving channels e are formed on the lever plates d1, d2, and d3, which work in such a manner as to engage pins not shown which are driven through the driving channels and project from a side of a mated connector, and to draw the pins toward the channels e.

An engagement holes f are formed on the right and left lever plates d1 and d2 and the operation lever d is engaged with the female connector a by engaging the engagement hole f with the pin b wyile stretching the right and left lever plates d1 and d2 utilizing a resiliency of the synthetic resin material to use the pins b as supporting points.

However, with the conventional connector described above, since the right and left plates d1 and d2 are engaged with the female connector a while stretching the levers, the efficiency of the work for mounting the operation lever d to the female connector a is poor.

SUMMARY OF THE INVENTION

The present invention has been accomplished to solve the drawbacks described above, and an object thereof is to provide a lever-operated connector in which an operation lever is efficiently connected to pins projecting from a connector.

A lever-operated connector assembly according to the present invention comprises: a connector; an operation lever to be rotatably connected to the connector; pins provided to the connector, the pins each having a pair of engagement flat portions which are substantially in parallel to each other, the engagement flat portions having opposing projections; engagement holes formed on the operation lever for engaging the pins; and guide notches being in communication with the engagement holes and opened at front portions of the operation lever, the guide notches each having a pair of opposing guide flat portions which are substantially in parallel to each other and are slidably contacted with the engagement flat portions, the guide notches having projections for preventing the connector and the operation lever from being disconnected from each other.

Further, another lever-operated connector assembly lever-operated connector assembly is provided with an offset portion at an outer end of the pin for preventing the connector and the operation lever from being disconnected from each other.

With the above lever-operated connector assembly, when the operation lever is pressed into the connector after fitting the guide flat portions of the operation lever to the engagement flat portions of the connector, the pins and the engagement holes are engaged with each other.

Further, the offset portions formed at the outer end of the pins prevent right and left lever plates from being stretched outwardly and disconnected from the pins.

BRIEF DESCRIPTION OF THE DRAWINGS

The present invention will be more apparent from the ensuring description with reference to the accompanying drawing wherein.

DETAILED DESCRIPTION OF PREFERRED EMBODIMENTS

Figure 1:
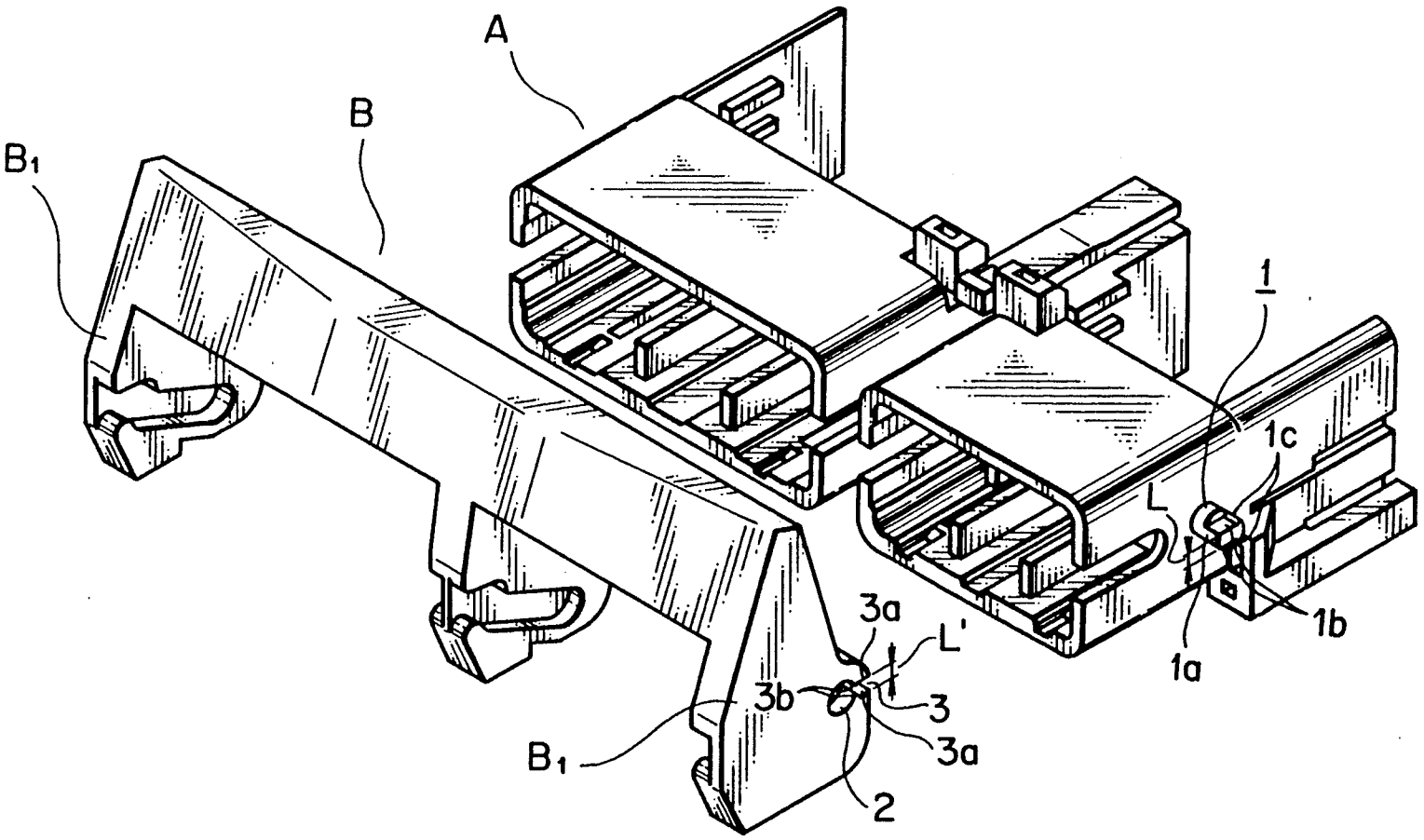
FIG. 1 is a perspective view showing a condition in which an operation lever and a connector according to an embodiment of the present invention are separated from each other.

In the FIG. 1, a female connector A made of synthetic resin material is provide with pins 1 at both sides thereof to mount an operation lever B. The pins 1 each has a pair of engagement flat portions 1*b* which are formed by cutting circumferential outer surfaces 1*a*. Further, a projection 1*c* is provided at an end of the engagement flat portions each to prevent the operation lever B from being slipped off.

A notch 3 for guiding the engagement with the female connector is formed on the right and left lever plates B1 each, which is opened at a portion of the lever plate and is in communication with the engagement hole 2. The notch 3 has guide flat portions 3*a* which are to oppose the engagement flat portions 1*b* of the pin 1. Further, the guide flat portions 3*a* are separated from each other with a distance L', which is slightly longer than the distance L between the engagement flat portions 1*b*, and the notch 3 is provided with projections 3*b* for preventing the disconnection of the operation lever B from the female connector A.

Figure 2:
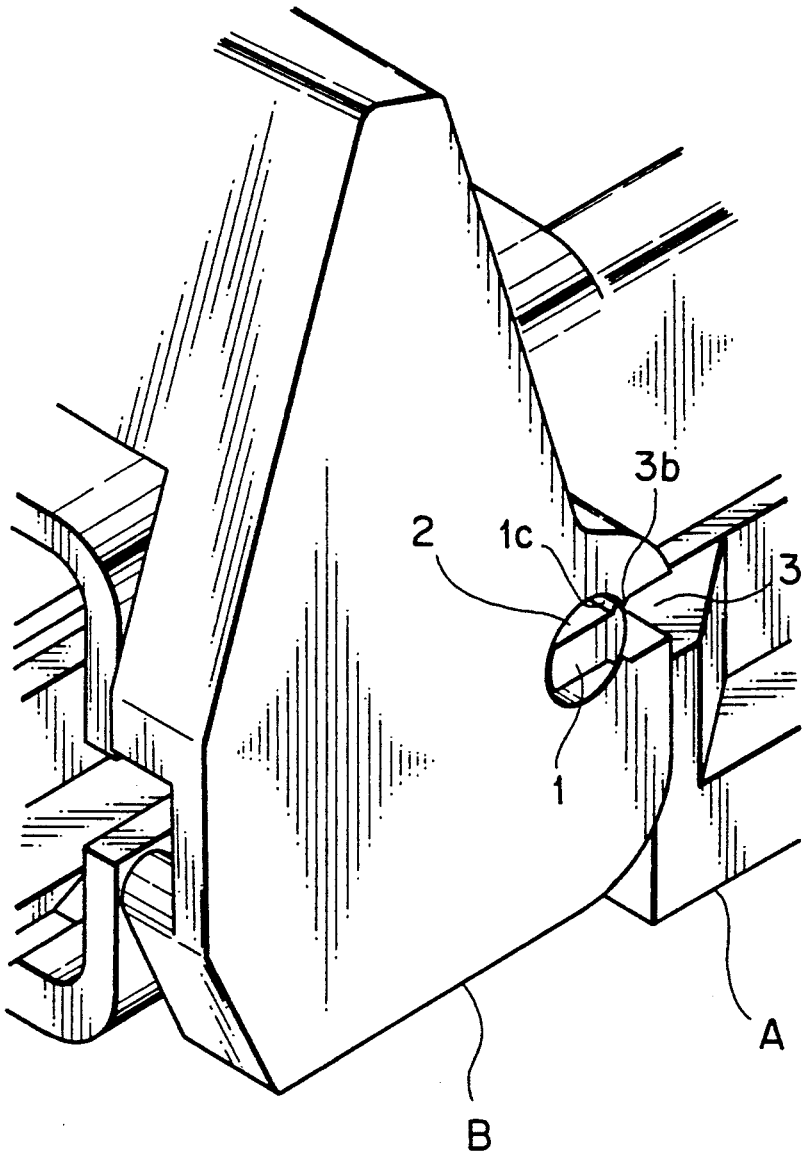
FIG. 2 is a perspective view showing a primary portion of the operation lever and the connector in FIG. 1 are connected to each other.

With the structure described above, in order to mount the operation lever B to the female connector A, the flat portions 3*a* of the notch 3 of the operation lever B is pushed into the engagement flat portions 1*b* of the pin 1 while the flat portions 3*a* being slidably contacted with the engagement flat portions 1*b*, and then the engagement holes 2 and the pins are rotatably engaged with each other just after the projections 3*b* pass through the projections 1*c*, as illustrated in FIG. 2.

Figure 3:
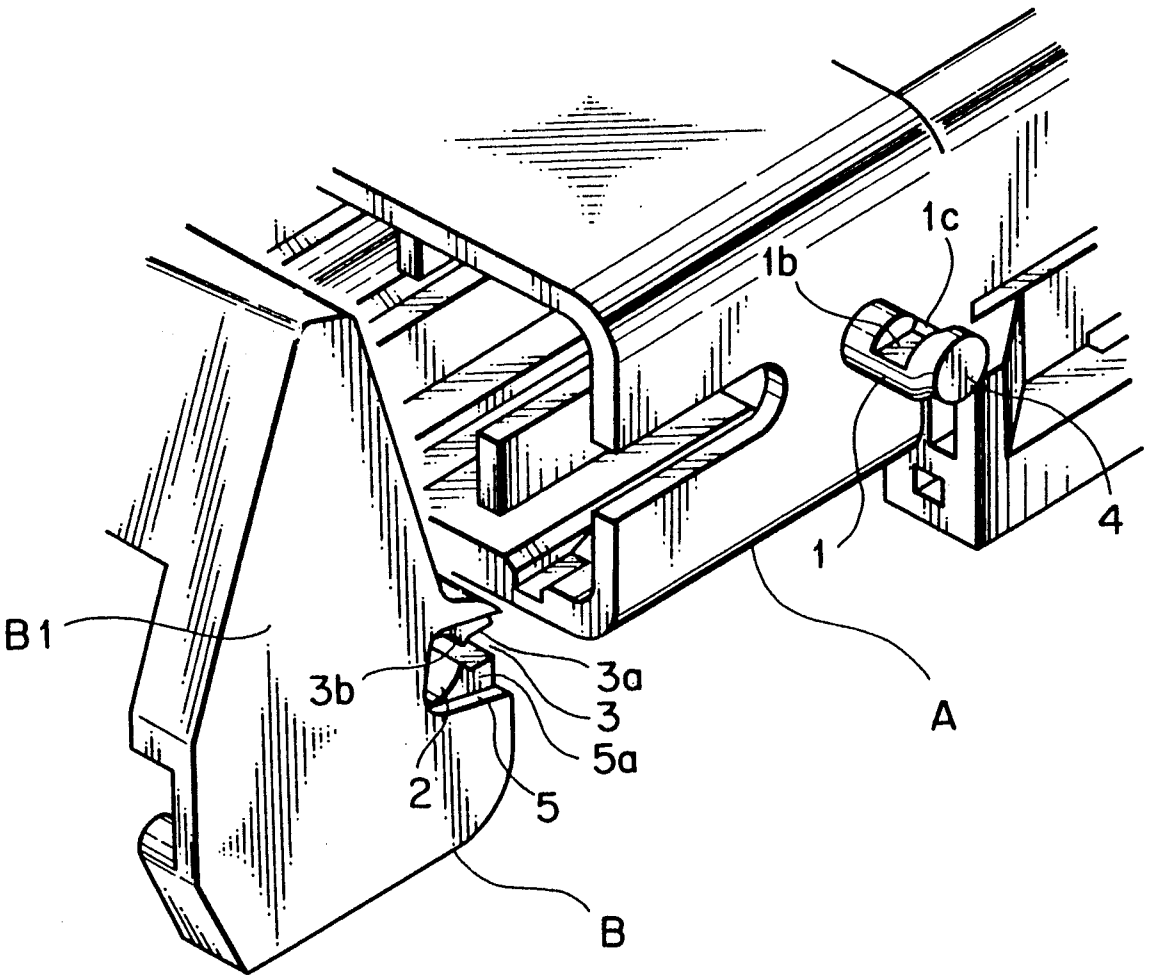
FIG. 3 is a perspective view showing a primary portion of an operation lever and a connector according to another embodiment of the present invention which are separated from each other.
Figure 4:
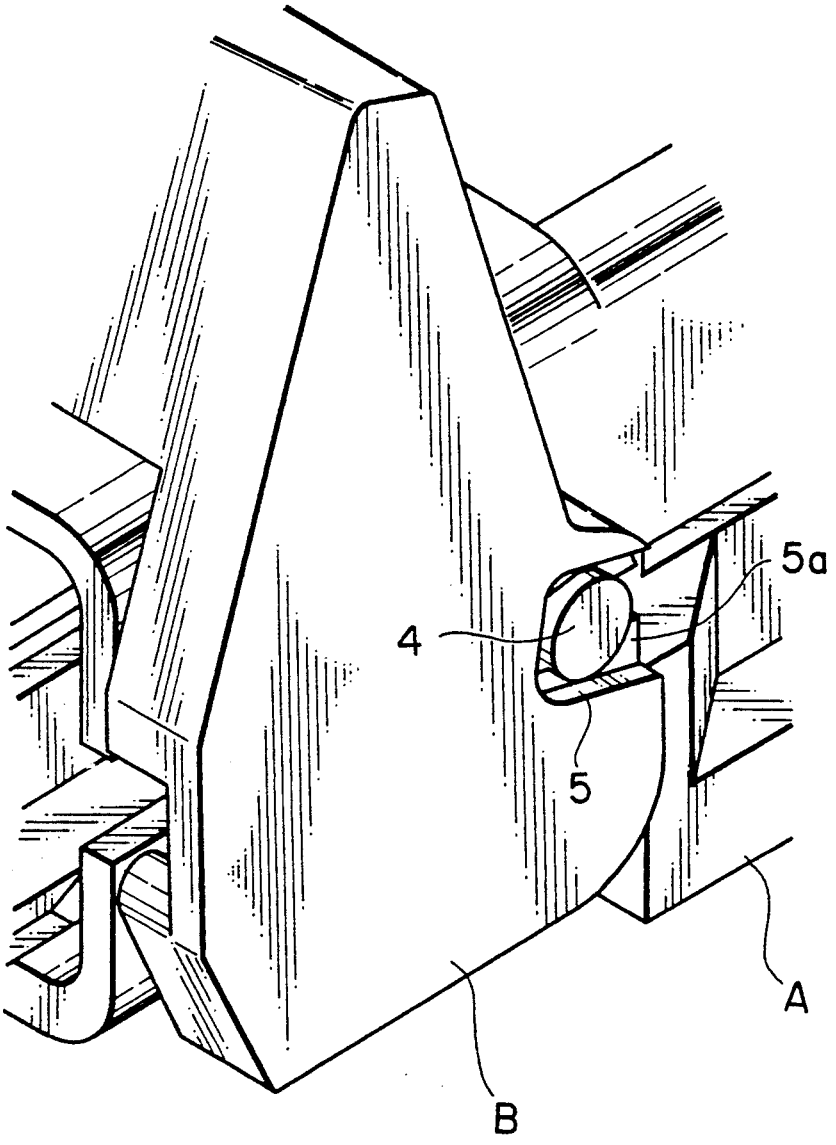
FIG. 4 is a perspective view showing a primary portion of the operation lever and the connector of FIG. 3 which are connected to each other.
Figure 5:
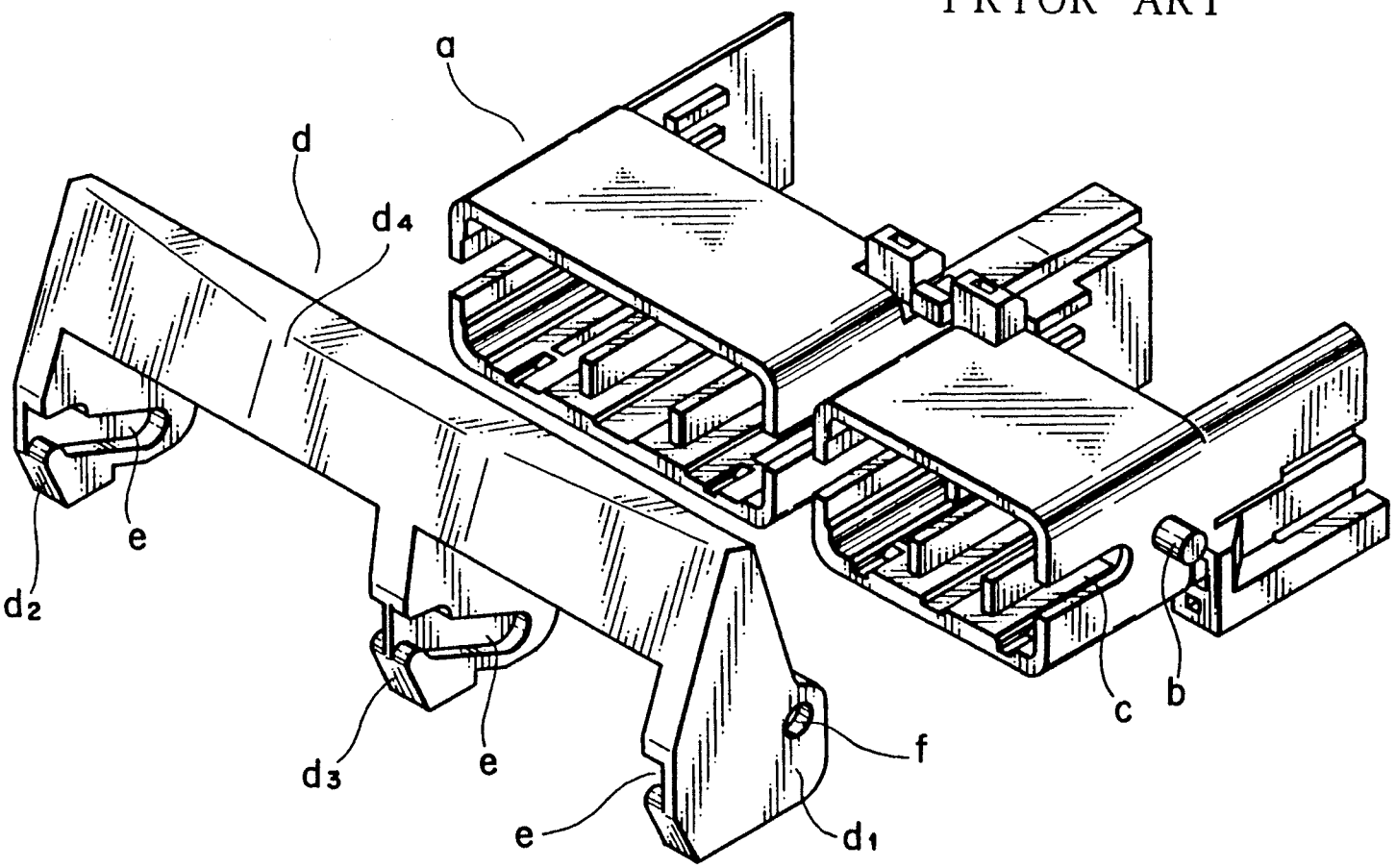
FIG. 5 PRIOR ART
FIG. 5 is a perspective view showing a condition in which conventional operation lever and connector are separated from each other.

In another embodiment of the present invention as shown in FIG. 3, an offset portion 4 is formed at an open end of the pin 1, and the operating plate B1 of the engagement operation lever B is provided with a concave portion 5 through which the offset portion proceeds. When assembled, the offset portion 4 engages an inner portion 5*a* of the concave portion 5.

In the lever-operated connector assembly according to the present invention, as described above, the circumferential outer portions of the pins provided to the connector are cut to form a pair of engagement flat portions, and the projections are formed at the engagement flat portions to prevent the connector and the operation lever from being disconnected. Further, the engagement holes are formed on the operation lever, which are engaged with the pins, and the guide notches are formed in such a manner as to be in communication with the engagement holes and opened at front portions of the operation lever. A pair of guide flat portions are formed at the guide notches so as to be slidably contacted with the engagement flat portions, and the projections are attached to the guide flat portions to prevent the operation lever from being slipped off. As a result, pressing the operation lever into the connector after fitting the engagement flat portions of the connector to the guide flat portions of the operation lever is all to connect the operation lever to the connector and to prevent the disconnection of the both due to the presence of the projections.

Further, offset portions formed at ends of the pins prevent the lever from being separated from the connector which may occur when the right and left lever plates are stretched outwardly.

What is claimed is:

1. A lever-operated connector assembly comprising:

a connector;

an operation lever to be rotatably connected to said connector;

pins provided to the connector, said pins each having a pair of engagement flat portions which are substantially in parallel to each other, said engagement flat portions having opposing projections;

engagement holes formed on said operation lever for engaging said pins; and guide notches being in communication with said engagement holes and opened at front portions of the operation lever, said guide notches each having a pair of opposing guide flat portions which are substantially in parallel to each other and are slidably contacted with the engagement flat portions, said guide notches having projections for preventing the connector and the operation lever from being disconnected from each other.

2. A lever-operated connector assembly as claimed in claim 1, wherein an offset portion is provided at an outer end of said pin for preventing the connector and the operation lever from being disconnected from each other.

* * * * *